US008595952B2

(12) United States Patent
Browne et al.

(10) Patent No.: US 8,595,952 B2
(45) Date of Patent: Dec. 3, 2013

(54) INTEGRATED HANGING SOLUTION

(75) Inventors: Jeffrey M. Browne, Chicago, IL (US); Benjamin D. Lowell, Benton Harbor, MI (US); Robert J. Messersmith, South Bend, IN (US); Christopher A. Warner, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 698 days.

(21) Appl. No.: 12/827,005

(22) Filed: Jun. 30, 2010

(65) Prior Publication Data

US 2012/0000086 A1 Jan. 5, 2012

(51) Int. Cl.

| | |
|---|---|
| ***A01F 25/12*** | (2006.01) |
| ***F26B 11/02*** | (2006.01) |
| ***A47H 1/00*** | (2006.01) |
| ***A47B 57/00*** | (2006.01) |
| ***A47F 5/12*** | (2006.01) |

(52) U.S. Cl.

USPC ..... 34/240; 34/239; 34/603; 211/100; 211/204; 211/172

(58) Field of Classification Search

USPC ..... 34/603, 240, 239, 180; 211/85.3, 99, 211/100, 204, 168, 172, 47, 80, 81, 96, 110, 211/116, 165, 167, 171

See application file for complete search history.

(56) References Cited

U.S. PATENT DOCUMENTS

| | | | | |
|---|---|---|---|---|
| 2,230,793 | A | 2/1941 | Borah | |
| 2,355,835 | A | 8/1944 | Whalen | |
| 2,434,891 | A * | 1/1948 | Swanson | 211/97 |
| 2,490,265 | A | 12/1949 | Gillespie | |
| 2,576,067 | A | 11/1951 | Chandler | |
| 3,399,783 | A | 9/1968 | Injeski | |
| 3,527,352 | A | 9/1970 | De Lapa | |
| 3,926,315 | A | 12/1975 | Bernard | |
| 4,086,709 | A | 5/1978 | Jackson | |
| 4,094,414 | A * | 6/1978 | Thiot et al. | 211/1.3 |
| 4,434,897 | A | 3/1984 | Gelhaus | |
| 4,789,069 | A | 12/1988 | Baus | |
| 5,690,236 | A | 11/1997 | Galilea | |
| 6,244,678 | B1 * | 6/2001 | Dopp et al. | 312/333 |
| 7,954,914 | B2 * | 6/2011 | Kendall et al. | 312/330.1 |
| 2007/0151301 | A1 | 7/2007 | Kendall et al. | |
| 2007/0151303 | A1 | 7/2007 | Doyle et al. | |
| 2007/0152550 | A1 | 7/2007 | Kendall et al. | |

FOREIGN PATENT DOCUMENTS

| | | | |
|---|---|---|---|
| DE | 3211316 | A1 | 9/1983 |
| DE | 4105112 | A1 | 8/1992 |
| DE | 10062849 | A1 | 7/2001 |
| DE | 10223539 | A1 | 12/2003 |
| JP | 7213792 | A | 8/1995 |

* cited by examiner

*Primary Examiner* — Kenneth Rinehart
*Assistant Examiner* — John McCormack

(57) ABSTRACT

A laundry apparatus comprising a housing having an exterior and defining a recess opening to the exterior and a hanging assembly slidably disposed in the recess. In a stored position the hanging assembly is disposed at least partially in the recess and in a use position the hanging assembly is disposed at least partially exteriorly of the recess.

19 Claims, 6 Drawing Sheets

INTEGRATED HANGING SOLUTION

BACKGROUND OF THE INVENTION

To hang articles of clothing after treatment in a laundry apparatus, a hanging system may be provided in close proximity to a laundry apparatus. A hanging mechanism may be purchased after market separately from the laundry apparatus or may be an integrated component of the laundry apparatus. Some integrated hanging systems may be retractable into the laundry apparatus when not in use for aesthetics and to not take up workspace and not be visible when not in use.

SUMMARY OF THE INVENTION

In one embodiment of the invention, a laundry apparatus comprises a housing having an exterior and defining a recess opening to the exterior, and a hanging assembly slidably disposed in the recess for movement between a stored position in which the hanging assembly is disposed at least partially in the recess and a use position in which the hanging assembly is disposed at least partially exteriorly of the recess, with the hanging assembly comprising: a first portion coupled to the housing; a second portion pivotally coupled to the first portion for movement about a first axis when the hanging assembly is in the use position; and a third portion pivotally coupled to the second portion for movement about a second axis that is spaced from the first axis when the hanging element is in the use position.

DESCRIPTION OF AN EMBODIMENT OF THE INVENTION

The present invention relates generally to a clothes hanging solution integrated with a laundry apparatus. More specifically, the invention is related to a hanging assembly integrated with a laundry apparatus which may be moveable between a stored position when not in use and in a use position when in use for hanging articles of clothing.

Figure 1:
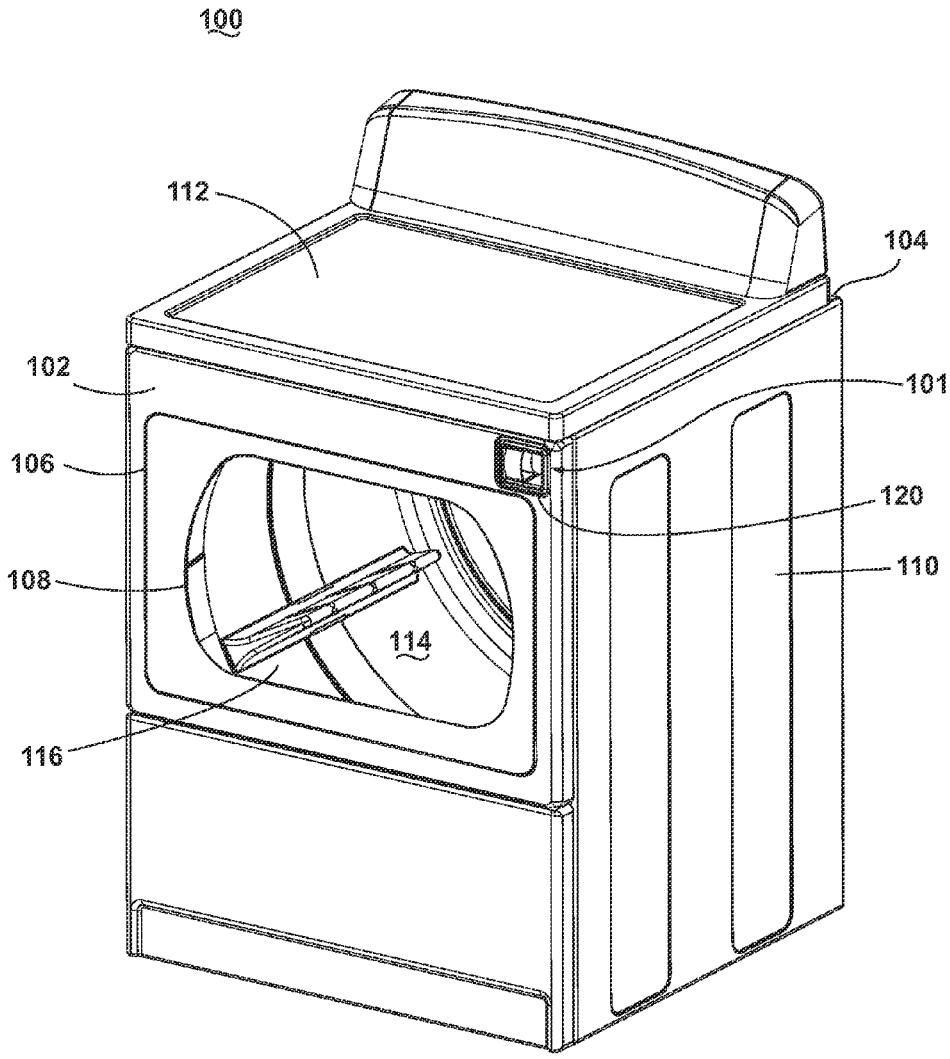
FIG. 1 is a perspective view of a laundry apparatus with a hanging assembly according to one embodiment of the invention in a stored position.

FIG. 1 is a schematic view of a laundry apparatus 100 with a hanging assembly 101 according to one embodiment of the invention. The laundry apparatus 100 may have a housing, which is formed by panels mounted to a chassis. As seen in FIG. 1, the panels may define a front housing surface 102, a rear housing surface 104, a side housing surface 110 and a top housing surface 112. The front housing surface 102 may include an opening that is selectively closed by a door 106 having a transparent window 108 within the door 106. The door 106 may be opened to access a drum 116 that defines a treatment chamber 114 for holding the laundry during the operation of the laundry apparatus 100.

Examples of the laundry apparatus 100 include, but are not limited to, a washing machine, including top-loading, front-loading, vertical axis, and horizontal axis washing machines, a dryer, such as a tumble dryer, including top-loading dryers and front-loading dryers, a combination washing machine and dryer, a tumbling refreshing machine, an extractor, a combination washer and dryer, and a non-aqueous washing apparatus. Other examples of laundry apparatus 100 include laundry modules or laundry accessories that provide other and/or additional laundry care functionality. U.S. patent application Ser. No. 11/322,742, filed on Dec. 30, 2005, gives several examples of laundry modules and is hereby incorporated by reference.

The laundry apparatus 100 may have a recess 120 in which the hanging assembly 101 is selectively received. As illustrated, the recess 120 may be accessible through the front housing surface 102. The hanging assembly 101 is shown in a stored position in FIG. 1 in which the hanging assembly 101 may be disposed at least partially in the recess 120. The recess 120 may reside in a portion of the laundry apparatus 100 that is substantially parallel to the radial axis of the treatment chamber 114. In a typical laundry appliance, this allows room for the hanging assembly 101 in space that is otherwise not used by the drum 116, and therefore, does not change the overall form factor of the laundry apparatus 100. Alternatively, the hanging assembly 101 may be stored in other portions of the laundry apparatus 100, such as in a position perpendicular to the radial axis of the treatment chamber 114 or in a control panel or backsplash of the laundry apparatus 100.

Figure 2:
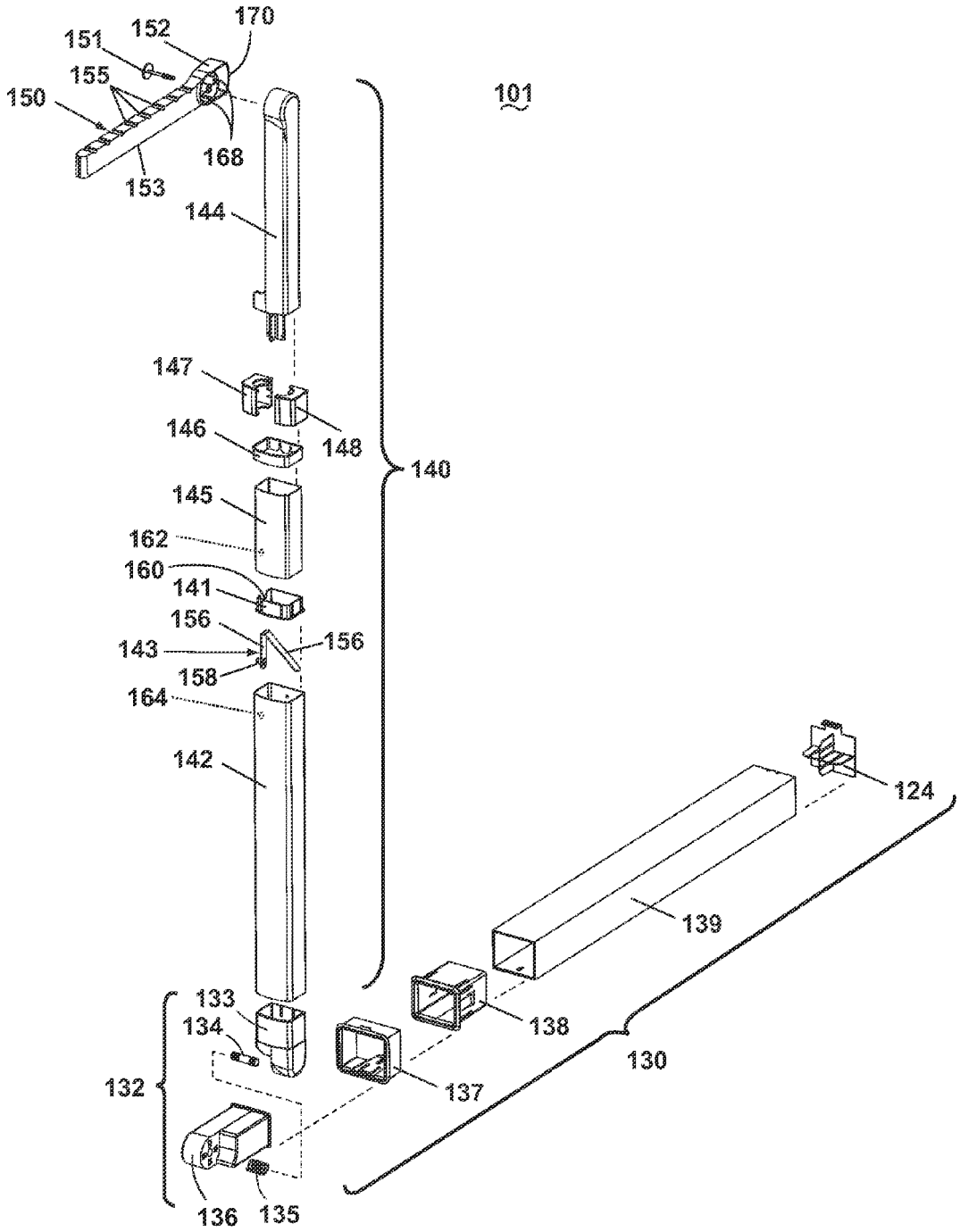
FIG. 2 is an exploded view of the hanging assembly of FIG. 1.

FIG. 2 is an exploded view of the hanging assembly 101 removed from the laundry apparatus 100. The hanging assembly 101 may include a first portion 130, a second portion 140, and a third portion 150, with a first hinge 132 coupling the first portion to the second portion, and a second hinge 152 coupling the second portion to the third portion.

As illustrated, the first portion 130 may include a slide 139, illustrated in the form of a tube, with an end plate 124 closing one end of the slide 139, and a hinge portion 132 coupled to the other end of the slide 139 by an inset fitting 138 and clamp fitting holding the inset fitting 138 to the slide portion 139. The end plate 124 may be attached to the slide portion 139 by way of interlocking features in both parts. There are holes (not shown) in the slide portion 139 into which protruded portions on the clamped fitting 137 fit to hold the assembly of the slide portion 139, the inset fitting 138, and the clamped fitting 137 together.

The first hinge 132 couples the first portion 130 and the second portion 140 of the hanging assembly 101. The first hinge 132 may include a first extension 136 that is attached to the clamped fitting 137. The first extension 136 may be attached to the clamped fitting 137 by slotted mated fittings on both pieces that fit together and hold the pieces in place. Alternatively, the clamped fitting 137 may be attached to the first extension 136 by welding the two pieces. The first extension 136 may be rotatably attached to a second extension 133 of the first hinge 132 by a pivot 134, such as double-ended screw, and a spring 135 surrounding the pivot 134.

As illustrated, the second portion 140 may include a telescopic extension having multiple telescopically connected elements, such as at least one distal element and one proximal element that may slide relative to each other to adjust the length of the extension. As illustrated, the second portion 140 includes a proximal first non-extendable element 142 coupled with a distal second extendable element 144 via an intermediate element 145. The first non-extendable element 142 may telescopically receive the second extendable element 144 and the intermediate element 145. The second extension 133 of the first hinge 132 may be attached to the first non-extendable element 142 to couple the second portion 140 to the first portion 130. As with the attachment of the first extension 136 to the clamped fitting 137 of the first portion 130, the attachment of the second extension 133 to the first non-extendable element 142 may be by slotted fittings or by welding of the two pieces.

The intermediate element 145 may be at least partially slidably received within the first non-extendable element 142, and may selectively be locked in a retracted or extended position by a mechanical lock 143 partially disposed within a mechanical clamp holder 141. The mechanical lock 143 includes a protrusion arm 154 attached to a spring arm 156 which biases the protrusion arm 154 against the inside of the first non-extendable element 142. A protrusion 158 may be provided on the protrusion arm 154. The mechanical clamp holder 141 may be attached to one end of the intermediate element 145 and includes a groove 160 for receiving the protrusion 158. The intermediate element 145 may have a through-hole 162 for allowing the protrusion 158 to pass through a side of intermediate element 145 when the mechanical lock 143 is mounted by the mechanical clamp holder 141. The first non-extendable element 142 also includes a through-hole 164 for allowing the protrusion 158 to pass through a side of the first non-extendable element 142. The through-hole 158 is formed in a location such that the intermediate element 145 and second extendable element 144 are extended with respect to the first non-extendable element 142 when the protrusion 158 is aligned with the through-hole 164. The mechanical lock 143 provides a means of locking the second extendable element 144 in an extended position when the hanging assembly 101 is in use to prevent an inadvertent retraction of the second extendable element 144 into the first non-extendable element 142. To disengage the mechanical lock 143, the protrusion is pushed into the through-hole 158 against the biasing force of the spring arm 156 and the second extendable element 144 and intermediate element 145 are slid into the first non-extendable element 142.

A clamp holder 146 may be attached to the intermediate element 145 on the end opposite the mechanical clamp holder 141. The clamp holder 146 holds a first portion of a clamp 147 and a second portion of a clamp 148 around a stem 166 of the second extendable element 144 to hold the second extendable element 144 to the first non-extendable element 142.

As illustrated, the third portion 150 may be an arm that may include a hanger 153 for supporting hanging articles and may have one or more notches or grooves 155 for supporting hanging items in spaced relation to each other. The grooves 155 may prevent hangers and articles from sliding off of the third portion 150. Alternatively, the third portion 150 may have a roughened finish or be covered with a material that aids in preventing slide-off. In another embodiment, the terminal or free end of the hanger 153 may include a raised feature to prevent slide-off. In such a configuration, the raised feature may be of a size to not prevent the third portion 150 and the second extendable element 144 of the second portion 140 from sliding into the first non-extendable element 142 of the second portion 140.

The hanger 153 may be attached to one end of the second extendable element 144 of the second portion 140 by a second hinge 152. A screw 151 pivotally couples the second hinge 152 to the second extendable element 144. The second hinge 152 allows rotation of the third portion 150 relative to the second portion 140. The second hinge 152 also has means to lock into place so that the third portion 150 does not rotate relative to the second portion 140 unintentionally. The locking means may include interlocking grooves 168 within the second hinge 152 which can be disengaged by pushing the third portion 150 and the second extendable element 144 of the second portion 140 together. Alternatively, the third portion 150 may hold in place relative to the second portion 140 of the hanging assembly 101 by frictional means. An end of the hanger 153 may form a finger pull 170 that a user may grasp and pull to effect at least a portion of the movement of the hanging assembly 101 from the stored position to the use position.

Although one embodiment of the hanging assembly 101 has been shown and described, it is readily apparent that variation from the embodiment shown is possible. There are a number of alternate structures for implementing an extendable second portion 140 of the hanging assembly 101, for example, by telescopically extending cylinders. In such a structure, there is a plurality of cylinders within cylinders, where each cylinder is frictionally coupled to the cylinder immediately inside and outside of it. In another embodiment, the third portion 150 may include more than one hanger 153, or the hanger 153 may extend in more than one direction from the second extendable element 144 of the second portion 140. In another embodiment, the third portion 150 may be attached to the second extendable element 144 somewhere other than the end of the second extendable element 144 of the second portion 140.

Figure 3:
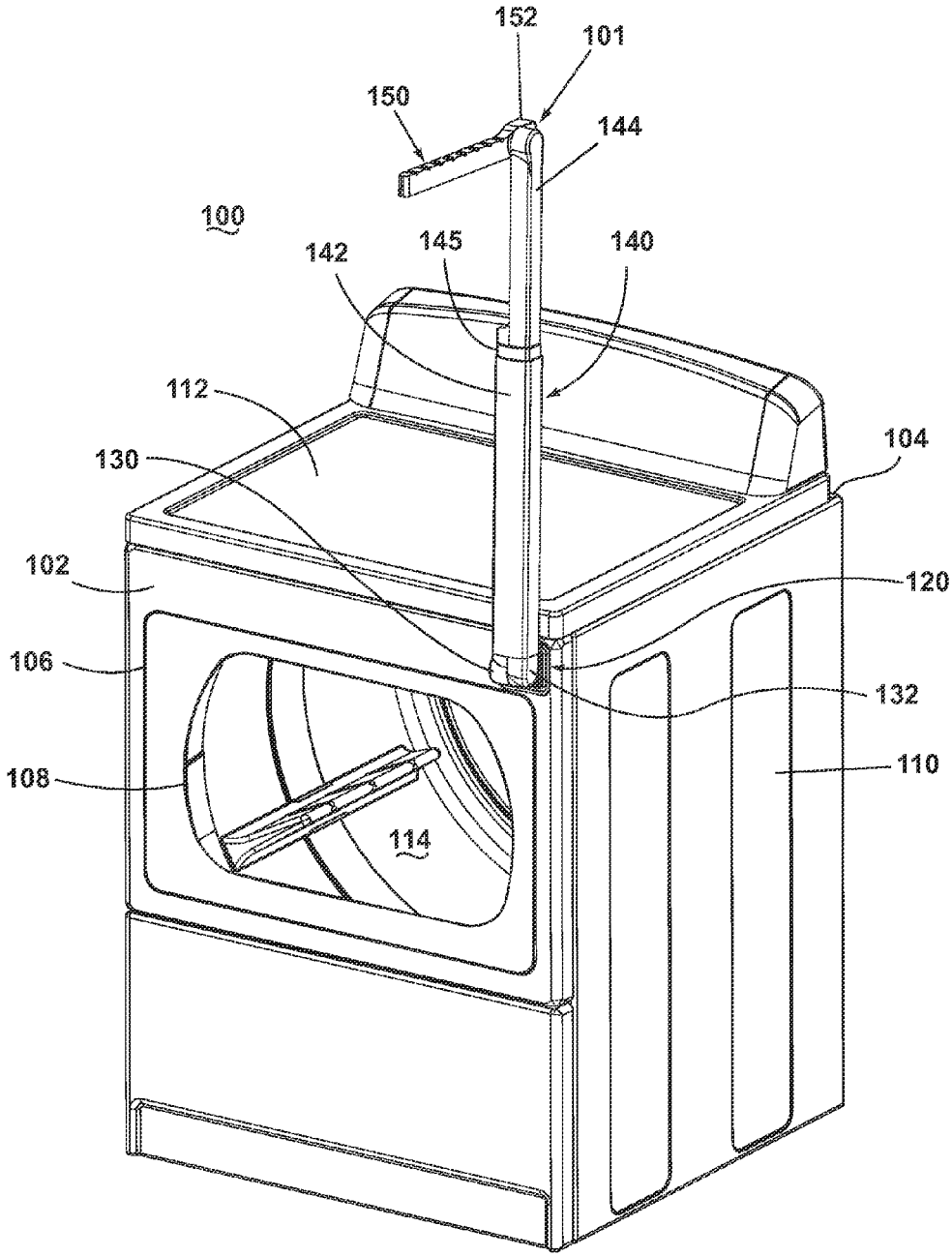
FIG. 3 is a perspective view of the laundry apparatus from FIG. 1 with the hanging assembly in a use position.

FIG. 3 shows a schematic view of the laundry apparatus 100 with the hanging assembly 101 in a use position. In the use position, the hanging assembly 101 can be used for hanging articles and may be disposed at least partially exteriorly of the recess 120. As illustrated, the hanging assembly 101 may protrude from the recess 120 in the front housing surface 102 of the laundry apparatus 100 adjacent to the door 106. The first portion 130 may be directly coupled to the housing within the recess 120 and is partially disposed within the recess 120 and partially extended from the recess 120. The second portion 140 may be pivoted to a generally vertical orientation with respect to the first portion 130, and the third portion 150 may be pivoted to a generally horizontal orientation with respect to the second portion 140. In the use position, the second extendable element 144 is extended from the first non-extendable element 142 of the second portion 140. The total length of the second portion 140 of the hanging assembly 101 may be such that the third portion 150 in the use position of the hanging assembly 101 is approximately between 24 inches and 48 inches above the top housing surface 112 of the laundry apparatus 100. In one embodiment, the total length of the second portion 140 of the hanging assembly 101 is such that the third portion 150 in the use position of the hanging assembly 101 is at least 36 inches above the top housing surface 112.

Returning to FIG. 1, in the stored position, the hanging assembly 101 may be disposed at least partially in the recess 120. As illustrated, the hanging assembly 101 may be folded and/or retracted such that the first, second, and third portions 130, 140, 150 are all received within the recess 120. The end of the hanging assembly 101 may be flush with, slightly distal of, or slightly proximal of the front housing surface 102. When in the stored position the second extendable element 144 of the second portion sits within the first non-extendable element 142 and the third portion 150 is folded against the second portion 140 (see FIG. 2).

Figure 7:
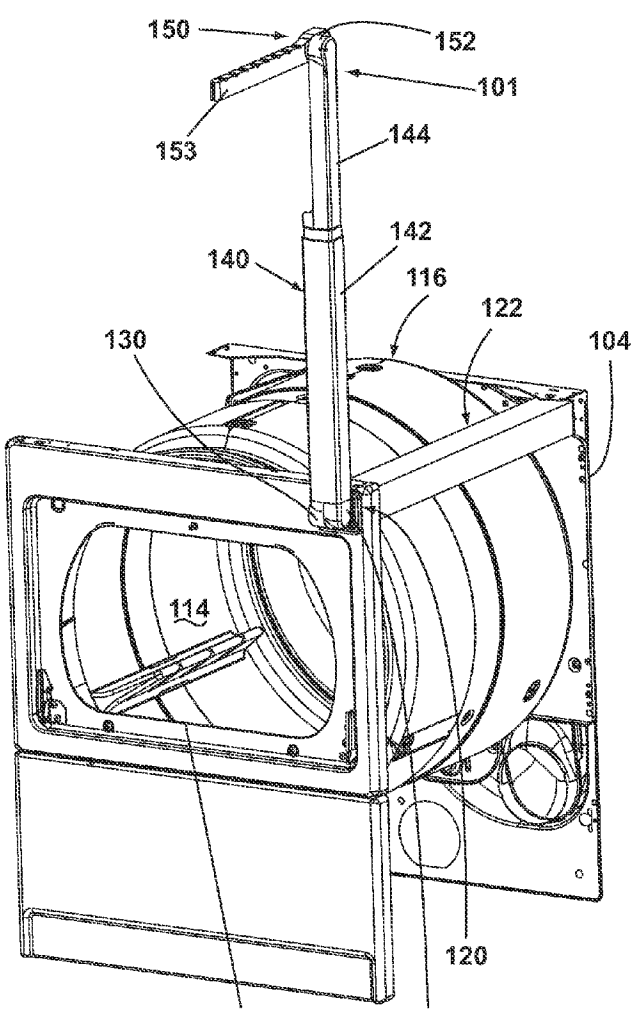
FIG. 7 is a perspective view similar to FIG. 4, with the hanging assembly in the use position shown in FIG. 3.

FIGS. 4-7 illustrate a sequence of positions for moving the hanging assembly 101 from the stored position shown in FIG. 1 and the use position shown in FIGS. 3 and 7.

Figure 4:
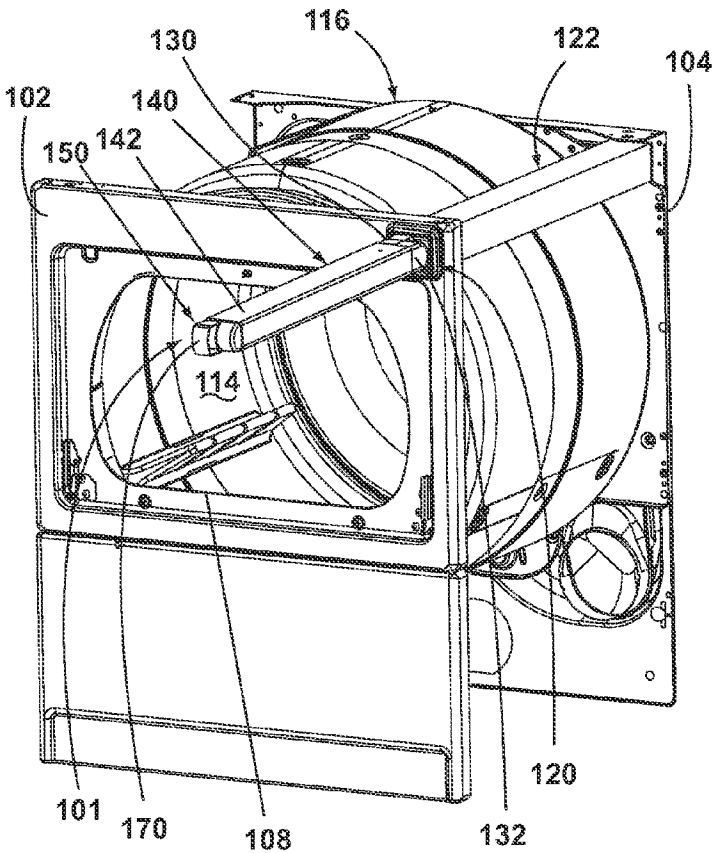
FIG. 4 is a perspective view of the laundry apparatus from FIG. 1 with a portion of the laundry apparatus removed for clarity and with a second portion of the hanging assembly partially extended.

FIG. 4 shows a schematic view of the laundry apparatus 100 with a portion of the laundry apparatus 100 removed for clarity and with the second portion 140 of the hanging assembly 101 partially extended. The recess 120 is defined by a hanging assembly housing 122, which is positioned such that an outer surface of the drum 116 does not contact the hanging assembly housing 122. The first portion 130 may be coupled to the hanging assembly housing 122 for slidably movement within the recess 120. As such, a sliding mechanism (not shown) may be provided for coupling the first portion 130 to the hanging assembly housing 122. The sliding mechanism may include rails, tracks, wheels, etc. within the hanging assembly housing 122 and on the first portion 130. A user may grasp and pull the finger pull 170 on the hanger 153 to effect the sliding of the first portion 130 within the recess 120. From the hanging assembly housing 122, the first portion 130 protrudes out from the front housing surface 102 of the laundry apparatus 100 such that the first hinge 132 is completely extended outside of the hanging assembly housing 122. In addition to the first portion 130, the first non-extendable element 142 of the second portion 140 protrudes from the front of the laundry apparatus 100. The second extendable element 144 of the second portion remains within the first non-extendable element 142, with the hanger 153 folded against the second extendable element 144. As such, the folded hanger 153 and second extendable element 144 fit inside the non-extendable element 142.

Figure 5:
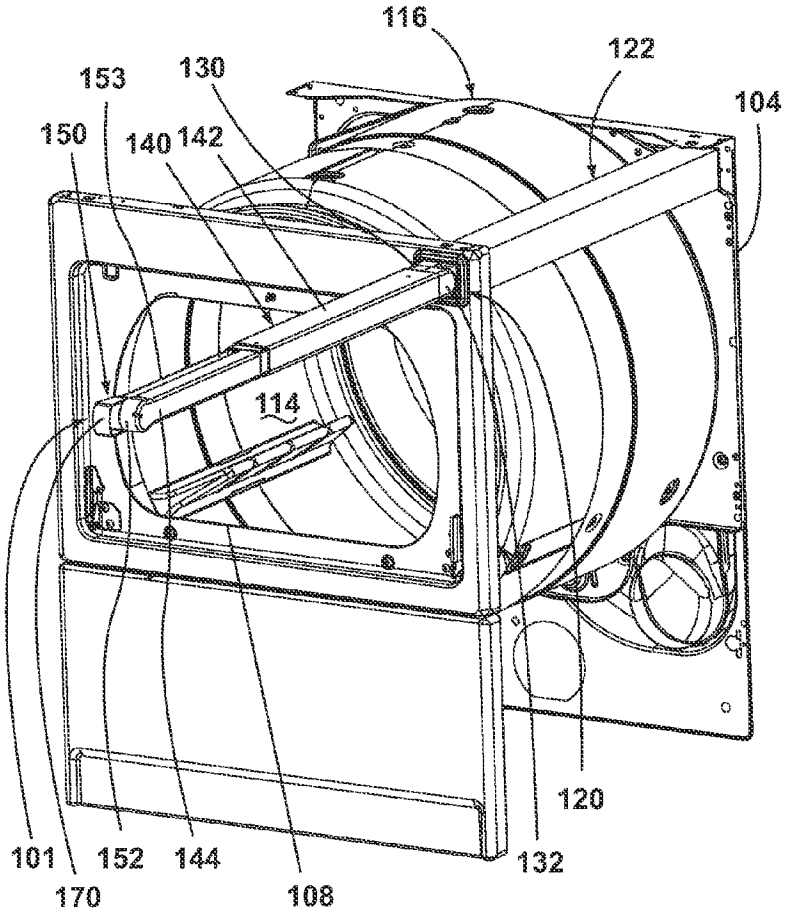
FIG. 5 is a perspective view similar to FIG. 4, with the second portion of the hanging assembly fully extended.

FIG. 5 is a schematic view similar to FIG. 4, with the second portion 140 of the hanging assembly 101 fully extended. The second extendable element 144 is extended from the first non-extendable element 142, and may be locked in position by the mechanical lock 143 (FIG. 2). A user may grasp and pull the finger pull 170 on the hanger 153 to effect the sliding of the second extendable element 144 within the first non-extendable element 142. The third portion 150 remains folded against the second extendable element 144. While only one extension length, the second extendable element 144, is shown in the illustrated embodiment, there may be multiple extension lengths which may be extended relative to the first non-extendable element 142. In yet another embodiment, the second extendable element 144 may be slidably mounted around the first element 142, in a manner such that the non-extended extendable element 144 surrounds the first non-extendable element 142.

Figure 6:
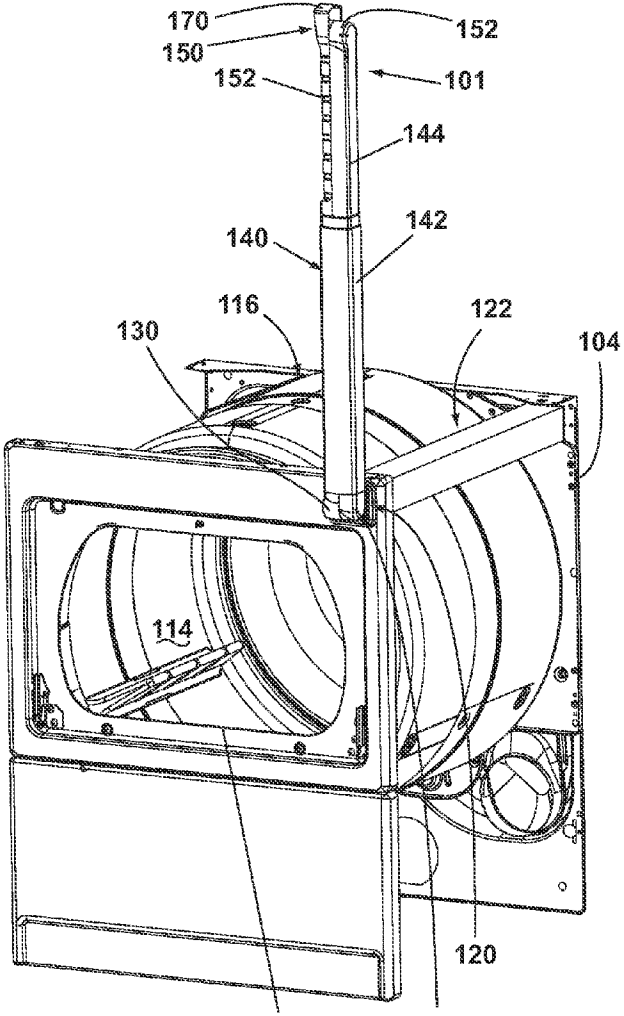
FIG. 6 is a perspective view similar to FIG. 4, with the second portion of the hanging assembly fully extended and pivoted in an upward direction.

FIG. 6 shows a schematic view similar to FIG. 4, with the second portion 140 of the hanging assembly 101 fully extended and pivoted in an upward direction. The second portion 140 may be pivoted about the first hinge 132 to an upright position where the second portion 140 extends in a direction normal to the ground. The first hinge 132 may rotate on an axis that is substantially parallel to the plane of the ground. The axis of rotation of the first hinge 132 may also be perpendicular to a longitudinal axis of the hanging assembly housing 122 containing the recess 120 wherein the hanging assembly 101 resides when in a stored position. The first hinge 132 may include means to lock in to place such that the second portion 140 does not accidentally pivot when the hanging assembly 101 is in the use position. In the position shown in FIG. 6, the third portion 150 remains folded against the second extendable element 144, with the hanger 153 disposed substantially parallel to the second extendable element 144 or the second portion 140.

As illustrated, the hanger 153 is shown to be approximately the same length as the second extendable element 144 of the second portion. However, the hanger 153 may be shorter or longer than the second extendable element 144. A longer length of the hanger 153 may be desirable since it would allow more space for hanging articles.

FIG. 7 shows a schematic view similar to FIG. 4, with the hanging assembly 101 in the use position shown in FIG. 3. The hanger 153 may be pivoted about the second hinge 152 to a position substantially perpendicular to the second portion 140. Like the first hinge 132, the second hinge 152 may also have an axis of rotation that is parallel to the plane of the ground. The second hinge 152 is shown to rotate in the same direction as the first hinge 132, but could alternatively rotate in a perpendicular direction or any direction with an axis of rotation that is parallel to the plane of the ground. When the hanging assembly 101 is in the use position, the second hinge 152 is spaced away from the first hinge 132 by a distance of the fully extended length of the second portion 140. The interlocking grooves 158 of the second hinge 152 insure that the hanger 153 does not unintentionally pivot relative to the second portion 140 when the hanging assembly 101 is in the use position.

Figure 8:
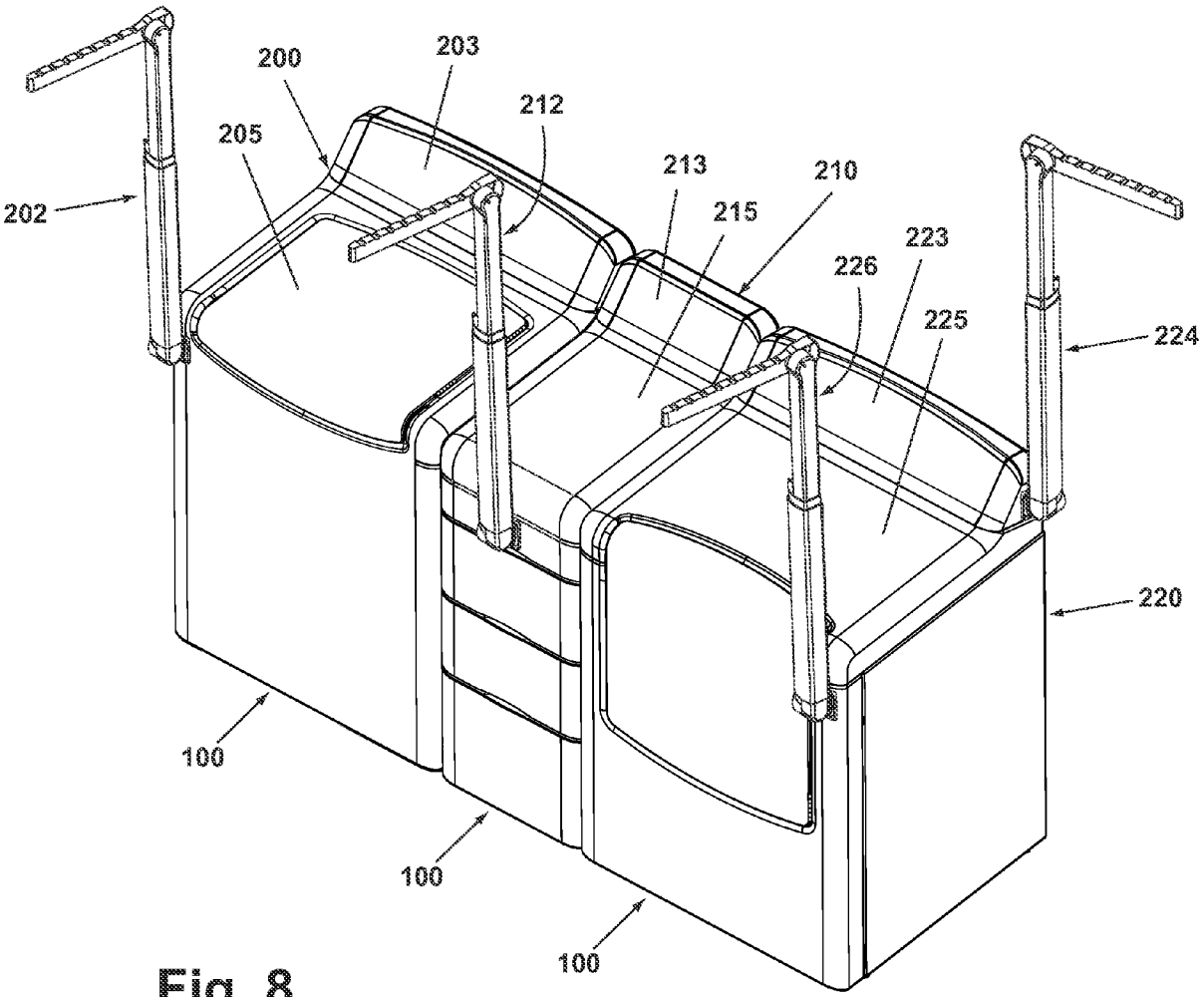
FIG. 8 is a perspective view of a modular system including multiple laundry apparatuses, each having at least one hanging assembly.

FIG. 8 shows a modular system of multiple laundry apparatuses 100 with multiple hanging assemblies. In one embodiment, the multiple laundry apparatuses 100 may include a laundry washer 200 with a top surface 205 and a control panel or backsplash 203 on the top surface 205, a laundry accessory in the form of a laundry and supply storage unit 210 with a top surface 215 and a control panel or backsplash 213 on the top surface 215, and a laundry dryer 223 with multiple storage elements such as drawers, a top surface 225, and a top storage element or backsplash 213 on the top surface 225. The laundry apparatuses 100 may be disposed adjacent one another, such as with the storage unit 210 between the laundry washer 200 and the laundry dryer 223. The laundry washer 202 and the laundry dryer 223 each have a hanging assembly 202, 226, respectively integrated thereon which is stored in a recess disposed in a front surface of the laundry washer or dryer 200, 226. The laundry dryer 223 may have an additional hanging assembly 224 integrated thereon which is stored within a recess in the control panel or backsplash 223, with the recess opening on a side of the laundry dryer 223. The laundry and supply storage unit 210 may have a hanging assembly 212 integrated thereon which is stored in a recess disposed in a front surface of the storage unit 210. The hanging assemblies 202, 212, 226 of FIG. 8 may be substantially similar in construction and operation to the hanging assembly 101 shown in FIGS. 1-7.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A laundry apparatus comprising:

a housing having an exterior and defining a recess opening to the exterior;

a hanging assembly slidably disposed in the recess for movement between a stored position in which the hanging assembly is disposed at least partially in the recess and a use position in which the hanging assembly is disposed at least partially exteriorly of the recess, and comprising:

a first portion coupled to the housing;

a second portion pivotally coupled to the first portion for movement about a first axis when the hanging assembly is in the use position; and a third portion pivotally coupled to the second portion for movement about a second axis that is spaced from the first axis when the hanging assembly is in the use position;

a drum defining a treating chamber located within the housing and defining an interior space between the drum and the housing; and a second housing located within the interior space and defining an enclosure, with the hanging assembly received within the second housing in the stored position.

2. The laundry apparatus of claim 1 wherein the housing comprises a top surface, and the third portion is at a height higher than the top surface when the hanging element is in the use position.

3. The laundry apparatus of claim 2 wherein the third portion is at least 36 inches above the top surface.

4. The laundry apparatus of claim 2 wherein the third portion overlies the top surface in the use position.

5. The laundry apparatus of claim 1 wherein the second portion comprises an extendable portion for adjusting the length of the second portion.

6. The laundry apparatus of claim 5 wherein the extendable portion comprises multiple telescopically-coupled elements.

7. The laundry apparatus of claim 1 wherein the first portion is slidably coupled to the housing for constrained slidable movement within the recess.

8. The laundry apparatus of claim 7 wherein the second portion is pivotable about the first axis and the third portion is pivotable about the second axis.

9. The laundry apparatus of claim 7 wherein the first, second, and third portions are all completely received within the recess in the stored position.

10. The laundry apparatus of claim 9 wherein the second and third portions are completely exterior of the recess in the use position.

11. The laundry apparatus of claim 1 wherein the second portion comprises a rotatable portion that is rotatable relative to the first portion to provide for adjusting the orientation of the third portion relative to the housing.

12. A laundry apparatus comprising:

a housing having an exterior defining a front face and a top surface, with a recess opening to the front face;

a hanging assembly comprising:

an elongated slide having opposing ends and slidably coupled to the recess for constrained slidable movement with the recess;

an extension having opposing ends, with an end of the extension pivotally mounted to an end of the slide for pivotal movement about a first axis; and a hanger having opposing ends, with one end of the hanger pivotally mounted to an end of the extension for pivotal movement about a second axis;

wherein the hanging assembly is slidable between a stored position, where the slide, extension and hanger are disposed at least partially in the recess, and a use position, where the extension and hanger are disposed at least partially exteriorly of the recess;

a drum defining a treating chamber located within the housing and defining an interior space between the drum and the housing; and a second housing located within the interior space and defining an enclosure, with the hanging assembly received within the second housing in the stored position.

13. The laundry apparatus of claim 12 wherein the recess is horizontally oriented, the first axis is horizontally oriented providing for the pivotal movement of the extension from a horizontal orientation to a vertical orientation, and the second axis is horizontally oriented providing for pivotal movement of the hanger to a horizontal orientation when the extension is in a vertical orientation.

14. The laundry apparatus of claim 13 wherein the extension has a horizontal orientation in the stored position and the extension has a vertical orientation during the use position.

15. The laundry apparatus of claim 14 wherein the hanger has a horizontal orientation in the use position and is at a height higher than the top surface.

16. The laundry apparatus of claim 15 wherein the extension comprises multiple telescopically connected elements to provide for adjusting the length of the extension.

17. The laundry apparatus of claim 16 wherein the multiple telescopically connected elements comprise at least a distal element and a proximal element, the hanger is pivotally mounted to the distal element, and the hanger and distal element can be collectively received by the proximal element in the stored position.

18. The laundry apparatus of claim 12 wherein an end of the hanger forms a finger pull that a user may grasp and pull to effect a sliding of the slide within the recess and a withdrawal of the extension and hanger from the recess as part of moving the hanging assembly from the stored to the use position.

19. The laundry apparatus of claim 18, further comprising a first lock configured to stop the rotation of the extension relative to the slide, and a second lock configured to stop the rotation of the hanger relative to the extension.

* * * * *